US008905822B2

(12) United States Patent
Meyer

(10) Patent No.: US 8,905,822 B2
(45) Date of Patent: Dec. 9, 2014

(54) CLAMP NUT

(75) Inventor: Jeffrey J. Meyer, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 306 days.

(21) Appl. No.: 13/268,010

(22) Filed: Oct. 7, 2011

(65) Prior Publication Data

US 2013/0090045 A1 Apr. 11, 2013

(51) Int. Cl.
*B24B 41/00* (2006.01)
*B24B 23/02* (2006.01)
*B24B 45/00* (2006.01)

(52) U.S. Cl.
CPC ..... *B24B 23/028* (2013.01); *B24B 45/003* (2013.01)
USPC ..... 451/359; 451/344; 451/358; 451/352

(58) Field of Classification Search
CPC ..... B23Q 3/1554; B23Q 3/15713; B24B 41/066; B24B 23/02; B24B 7/188
USPC ..... 451/358, 359, 344, 352; 29/426.1, 29/525.11, 428, 402.1, 402.08; 81/176.1, 81/436
See application file for complete search history.

(56) References Cited

U.S. PATENT DOCUMENTS

| | | | | |
|---|---|---|---|---|
| 1,330,098 | A | 2/1920 | Smith | |
| 3,408,924 | A * | 11/1968 | Mueller | 100/35 |
| 4,566,357 | A * | 1/1986 | Carossino | 81/177.2 |
| 4,976,071 | A | 12/1990 | Stabler | |
| 5,366,312 | A * | 11/1994 | Raines | 403/3 |
| 5,366,330 | A | 11/1994 | Cosenza | |
| 5,558,571 | A * | 9/1996 | Toyoshima et al. | 451/358 |
| D407,302 | S | 3/1999 | Lawson | |
| 5,947,671 | A | 9/1999 | Kanaan et al. | |
| 5,964,006 | A * | 10/1999 | Holmes et al. | 15/180 |
| 6,290,442 | B1 * | 9/2001 | Peterkort | 411/140 |
| 6,341,927 | B2 | 1/2002 | Hampson et al. | |
| 6,345,557 | B1 * | 2/2002 | Kuo | 81/177.2 |
| 6,519,830 | B1 * | 2/2003 | Mehan | 29/525.01 |
| 6,645,058 | B2 * | 11/2003 | Puzio et al. | 451/365 |
| 6,799,358 | B2 * | 10/2004 | Satran | 29/426.1 |
| 6,827,074 | B2 | 12/2004 | Gardner | |
| 6,893,335 | B2 * | 5/2005 | MacKay | 451/359 |
| 7,000,606 | B2 | 2/2006 | Gardner | |
| 7,143,760 | B2 | 12/2006 | Gardner | |

(Continued)

FOREIGN PATENT DOCUMENTS

| | | | | |
|---|---|---|---|---|
| DE | 31 10 912 | A1 | 9/1982 | |
| EP | 236537 | A1 * | 9/1987 | B25B 11/00 |
| EP | 1 724 057 | A2 | 11/2006 | |
| EP | 1946889 | A1 * | 7/2008 | B24B 23/02 |

OTHER PUBLICATIONS

European Search Report—Feb. 2014.

*Primary Examiner* — George Nguyen
(74) *Attorney, Agent, or Firm* — Amir Rohani; Scott Markow

(57) ABSTRACT

A flange nut for use in mounting a power tool component onto a rotatable spindle of a power tool. The flange nut includes one or more non-circular apertures into which an end of a shaped tool such as an Allen wrench may be inserted. Torquing or otherwise applying a force to a portion of the shaped tool serves to thread the nut along the spindle either towards the power tool component to secure the power tool component on the spindle or away from the power tool component to allow for removal of the power tool component.

30 Claims, 8 Drawing Sheets

(56) References Cited

U.S. PATENT DOCUMENTS

| | | | | |
|---|---|---|---|---|
| 7,201,644 | B2 | 4/2007 | Gardner | |
| 7,207,247 | B1 * | 4/2007 | Kirby | 81/436 |
| 7,402,095 | B2 | 7/2008 | Gardner | |
| 7,708,510 | B2 | 5/2010 | Reimler | |
| 7,877,948 | B2 | 2/2011 | Davies | |
| 8,151,679 | B2 * | 4/2012 | Bohne | 83/698.11 |
| 8,393,252 | B2 * | 3/2013 | Hsieh | 81/63.2 |
| 8,475,234 | B2 * | 7/2013 | Ho | 451/342 |
| 8,585,469 | B2 * | 11/2013 | Grunikiewicz | 451/342 |
| 8,640,580 | B2 * | 2/2014 | Bohne | 83/13 |
| 2002/0119740 | A1 * | 8/2002 | Puzio et al. | 451/350 |
| 2003/0176147 | A1 * | 9/2003 | Krondorfer et al. | 451/5 |
| 2006/0246827 | A1 * | 11/2006 | Gardner | 451/359 |
| 2007/0049176 | A1 * | 3/2007 | Jones | 451/28 |
| 2009/0077833 | A1 | 3/2009 | Kokavec | |
| 2010/0105301 | A1 * | 4/2010 | Whelan | 451/359 |
| 2010/0159813 | A1 | 6/2010 | Pajovic | |
| 2010/0284765 | A1 * | 11/2010 | Clarke | 411/149 |
| 2012/0144971 | A1 * | 6/2012 | Bohne | 83/698.11 |
| 2012/0159792 | A1 * | 6/2012 | Hoelscher | 30/275.4 |
| 2012/0270484 | A1 * | 10/2012 | Imai et al. | 451/548 |

* cited by examiner

CLAMP NUT

FIELD OF THE INVENTION

The present invention generally relates to fasteners that secure power tool components on rotatable spindles and, more particularly, to a flange nut having at least one non-circular opening into which a shaped tool may be inserted for facilitating movement of the flange nut along the spindle either towards or away from the power tool component.

BACKGROUND OF THE INVENTION

Many types of power tools include some variation of a power tool component (e.g., disc, blade) mounted on a spindle or shaft for rotation therewith to perform useful work. One type of such a power tool is an angle grinder having a grinder wheel or disk mounted on a rotary shaft for use in grinding and sanding applications. Another such power tool is a circular saw having a saw toothed disc or blade mounted on a rotary shaft for use in cutting wood or other materials. To secure the power tool component to the spindle, the component is initially mounted over the spindle so that a central bore in the component receives the spindle. A nut or other type of fastener may then be mounted onto the spindle and threaded therealong in a first direction to compress the component between the nut and a flange or other feature disposed about the spindle. The nut may also be threaded along the spindle in an opposed, second direction to allow for removal of the component (e.g., to replace a defective or broken component, to utilize a different type of component, etc.). The nut typically includes a pair of spaced apertures into which a corresponding pair of spaced pins of a spanner wrench or other similar tool may be inserted for use in rotating the nut in a desired direction.

BRIEF SUMMARY OF THE INVENTION

The present use of spanner wrenches or other similar types of tools to thread a nut in a desired direction along a spindle of a power tool suffers from a number of drawbacks that could be alleviated with a simpler and more efficient arrangement. For instance, as a spanner wrench generally resides in a single plane, a user is more likely to scrape or otherwise injure the user's hand (e.g., knuckles) via contact with the nut or other portion of the power tool. Furthermore, as a spanner wrench includes a single pair of spaced pins, a user is only afforded with two wrench positions (e.g., spaced 180° apart) from which the user can apply torque to the nut. Still further, spanner wrenches are relatively more expensive than other types of wrenches available on the market today.

To address or alleviate at least some of the above-mentioned drawbacks resulting from the present use of spanner wrenches to thread a nut along a power tool spindle, disclosed herein is a flange or lock nut that may be threaded onto a spindle of a power tool and that includes at least one aperture having a cross-section that is other than circular. The non-circular aperture allows a correspondingly shaped non-circular end of a tool to be inserted therein and torqued to induce a corresponding torque of the flange nut.

In one aspect, an angle grinder is disclosed including a field case having a handle coupled to a first end thereof, a motor disposed within the field case and having a rotor extending axially therefrom, a gear case coupled to a second end of the field case opposite the handle and having a wheel spindle extending therefrom and being operatively coupled to the rotor by at least one gear, an upper flange disposed about the wheel spindle, a grinder wheel disposed on the wheel spindle for rotation therewith, and a lower flange disposed about the wheel spindle and opposite the upper flange so that the grinder wheel is disposed between the upper and lower flanges. The lower flange includes a body, an annular bore extending through the body and that threadingly receives the wheel spindle, and at least one aperture extending at least partially through the body and spaced from the annular bore. The at least one aperture has a cross-sectional shape that is other than circular.

For instance, the end of an Allen wrench (or other polygonal key) may be inserted into the at least one aperture (e.g., having a corresponding hexagonal shape) and torqued to induce a corresponding rotation of the flange nut about the spindle to move the flange nut either towards or away from the grinder wheel (i.e., due to the interaction between the non-circular aperture and the non-circular end of the Allen wrench preventing or at least limiting relative rotation between the aperture and the wrench). Use of the Allen wrench or other similar tool advantageously reduces the likelihood of injury to a user's hand during torquing of the flange nut (e.g., due to the offset nature of the Allen wrench), provides an increased number of starting positions from which the flange nut can be torqued, and the like.

Any of the embodiments, arrangements, or the like discussed herein may be used (either alone or in combination with other embodiments, arrangement, or the like) with any of the disclosed aspects. Merely introducing a feature in accordance with commonly accepted antecedent basis practice does not limit the corresponding feature to the singular Any failure to use phrases such as "at least one" does not limit the corresponding feature to the singular. Use of the phrase "at least generally," "at least partially," "substantially" or the like in relation to a particular feature encompasses the corresponding characteristic and insubstantial variations thereof. Furthermore, a reference of a feature in conjunction with the phrase "in one embodiment" does not limit the use of the feature to a single embodiment.

In addition to the exemplary aspects and embodiments described above, further aspects and embodiments will become apparent by reference to the drawings and by study of the following descriptions.

DETAILED DESCRIPTION OF THE INVENTION

Figure 1:
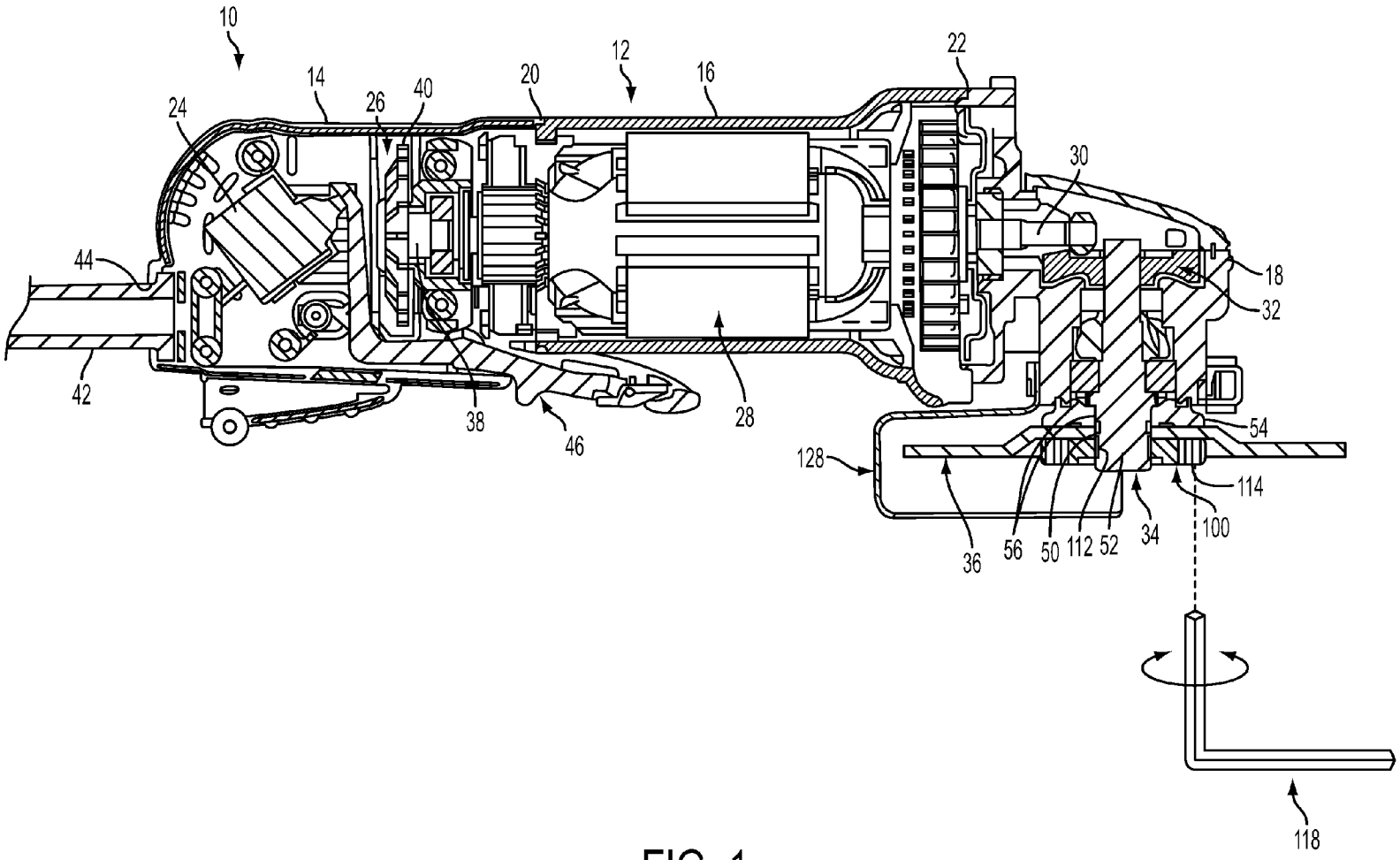
FIG. 1 is a side, cross-sectional view of an angle grinder including a flange nut for securing a grinder wheel to a rotatable spindle according to one embodiment.
Figure 2:
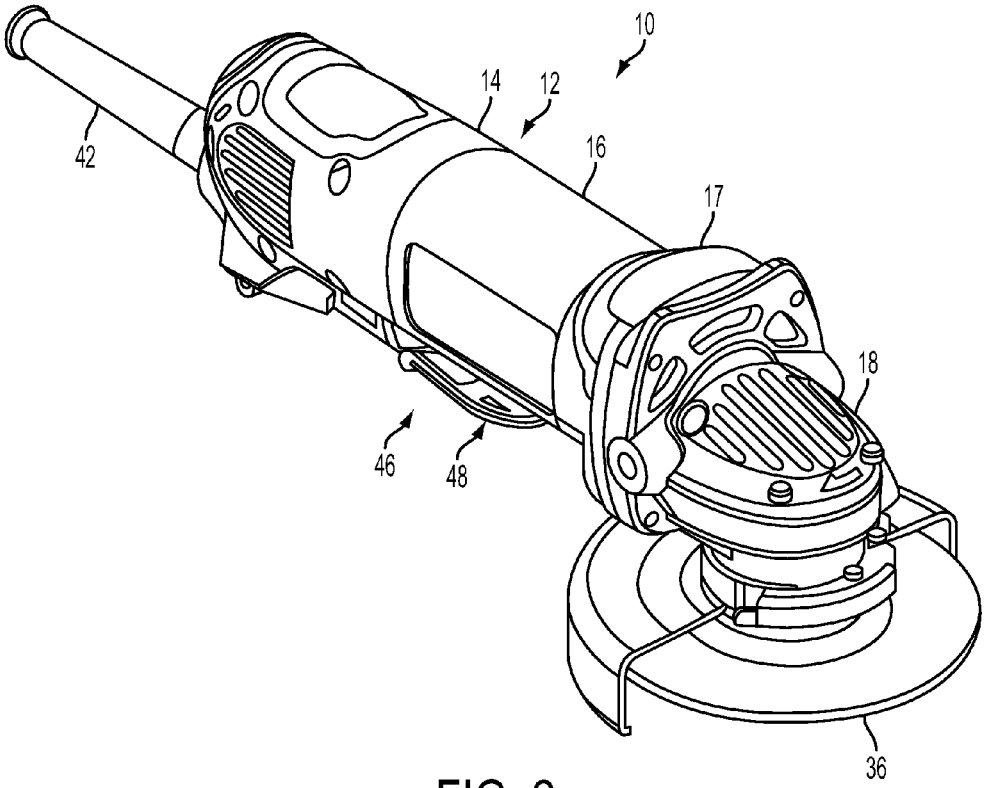
FIG. 2 is an upper perspective view of the angle grinder of FIG. 1.
Figure 3A:
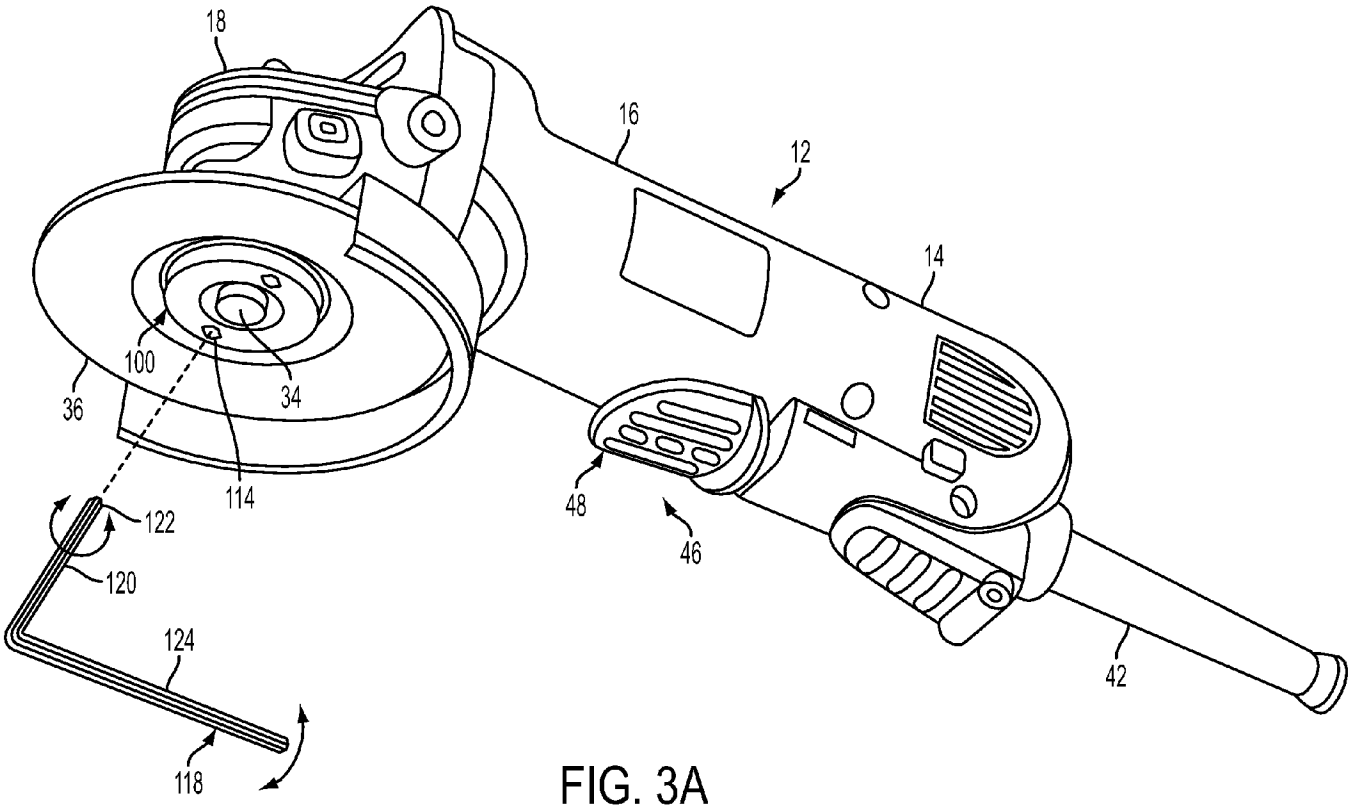
FIG. 3A is a lower perspective view of the angle grinder of FIG. 1 and illustrating an Allen wrench for use with the flange nut.

With reference to FIGS. 1-3, an angle grinder 10 (e.g., large, medium or small angle grinder) is illustrated that may utilize a clamp or flange nut 100 as disclosed herein for use in securing a power tool component (e.g., grinder wheel) to a rotatable spindle of the angle grinder 10. A representative angle grinder is disclosed in U.S. Pat. No. 7,722,444, the entirety of which is incorporated herein by reference. While the flange nut 100 will be primarily discussed in the context of the angle grinder 10, it should be understood that discussion of the angle grinder 10 is merely to facilitate the reader's understanding of the functionality of the flange nut 100. Stated otherwise, the flange nut 100 may be utilized in numerous other power tool contexts such as with, circular saws, wood routers, and the like. As will be discussed and more readily appreciated below, the flange nut 100 includes one or more non-circular apertures that serve to facilitate threading of the flange nut 100 along a rotatable spindle to mount or remove a component in a manner that is more efficient as compared to previous flange nuts or other such fasteners.

As shown, the angle grinder 10 may include a housing 12 having a handle portion 14, a field case 16, and a gear case 18. The handle portion 14 may be fixedly attached to a first end 20 of the field case 16 and the gear case 18 may be fixedly attached to a second end 22 of the field case 16. The handle portion 14 may support a switch 24 and associated components, a particle separation assembly 26, and the like. The field case 16 may support a motor 28 having a rotor 30 that extends into the gear case 18 for driving one or more gears (e.g., such as gearset 32) supported therein. The rotor 30 has a spindle rotational axis. A wheel shaft or spindle 34 may extend from gear case 18 and be rotatably driven by the rotor 30 through the gearset 32. In one arrangement, the axis of rotation of rotor 30 may be generally perpendicular to the axis of rotation of the wheel spindle 34. A power tool component such as a grinder wheel 36 may be selectively attachable to the wheel spindle 34 and rotatably driven thereby. The motor 28 may also have a second spindle 38 that extends into the handle portion 14 for rotatably driving a fan 40 associated with the particle separation assembly 26.

The switch 24 may be in electrical communication with the motor 28 via one or more conductive wires (not shown) and in electrical communication with a power source via a cord 42 including a plug (not shown). For instance, the handle portion 14 may include an opening 44 through which the cord 42 may run. Furthermore, a trigger 46 may be in mechanical communication with the switch 24 for selectively supplying power to the motor 28. Mechanical actuation of the trigger 46 results in actuation of the switch 24 and thus operation of the angle grinder 10 (i.e., rotation of the grinder wheel 36 via the rotor 30, gearset 32 and wheel spindle 34).

With particular reference to FIG. 1, the grinder wheel 36 may be secured to the wheel spindle 34 for rotation therewith by way of disposing a central bore 50 of the grinder wheel 36 over an end 52 of the wheel spindle 34 (i.e. so that the central bore 50 receives the wheel spindle 34) and then threading a flange nut 100 over the end 52 of the wheel spindle 34 until the grinder wheel 36 is at least somewhat compressed between the flange nut 100 and a stop 54. In one arrangement, the stop 54 may be in the form of any appropriate projection or member that is disposed generally adjacent the wheel spindle 34 and that is non-movable relative to the wheel spindle 34 at least in an axial direction relative to the wheel spindle 34. For instance, the stop 54 may be in the form of a disc or flange having a central bore 56 that may be threaded or otherwise slidably disposed over the end 52 of the wheel spindle 34. In one arrangement, the stop 54 may be referred to as an "upper flange" or "first flange" and the flange nut 100 may be referred to as a "lower flange" or "second flange."

Figure 4:
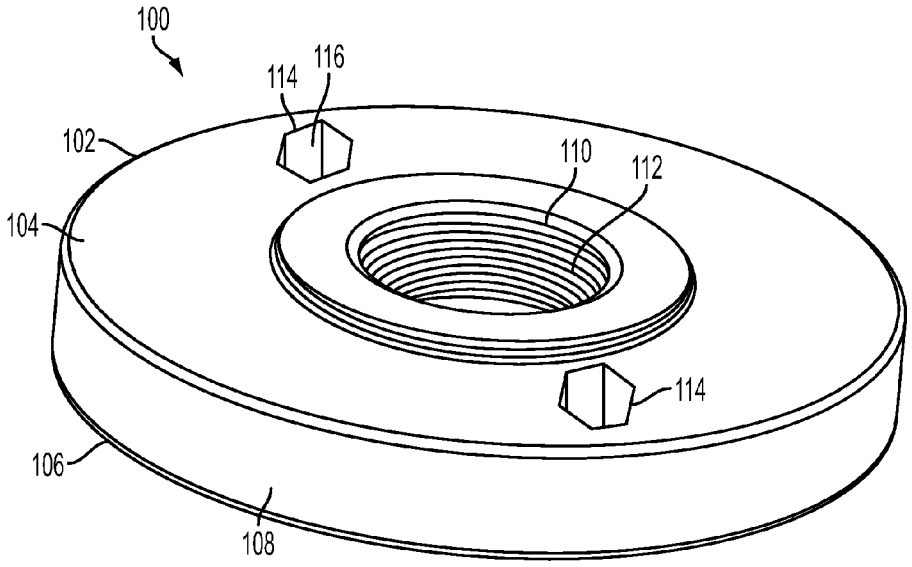
FIG. 4 is an upper perspective view of the flange nut of FIG. 1.
Figure 5A:
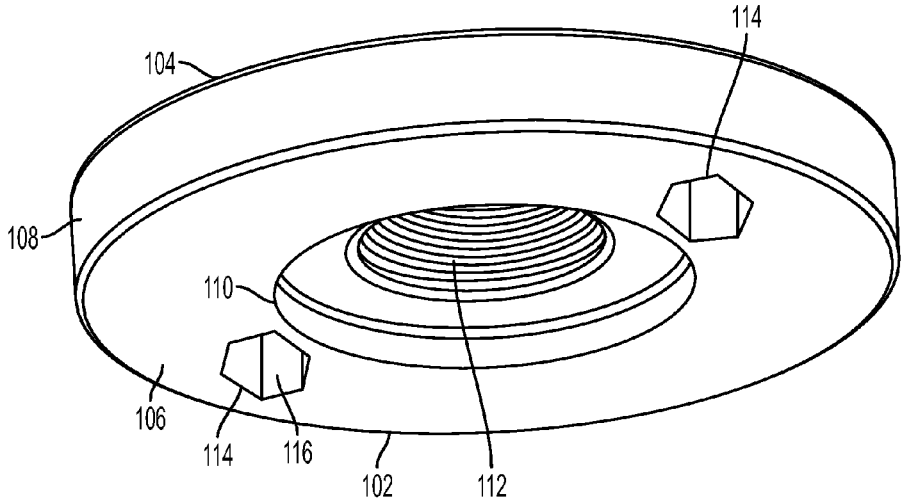
FIG. 5A is a lower perspective view of the flange nut of FIG. 1.

Turning now to FIGS. 4-5, opposing perspective views of the flange nut 100 are illustrated. The flange nut 100 may generally include a body 102 constructed of any appropriate material (e.g., metals, plastics, combinations thereof, etc.) including a first surface 104 that is adapted to face a component, a second surface 106 that is generally opposed to the first surface 104, and an outer circumferential surface 108 between the first and second surfaces 104, 106. The flange nut 100 also includes an annular bore 110 extending through the body 102 between the first and second surfaces 104, 106 for receiving the wheel spindle 34 therethrough. For instance, the body 102 may include an inner threaded surface 112 that generally surrounds the annular bore 110 and that is adapted to mate or engage with a corresponding threaded surface (not shown) on the wheel spindle 34 (see FIG. 1), such as generally adjacent the end 52 of the wheel spindle 34. As discussed above, the end 52 of the wheel spindle 34 may be disposed through the annular bore 110 of the flange nut 100. For instance, the inner threaded surface 112 may be threaded over a corresponding threaded outer surface of the wheel spindle 34 either towards or away from the stop 54.

Figure 5B:
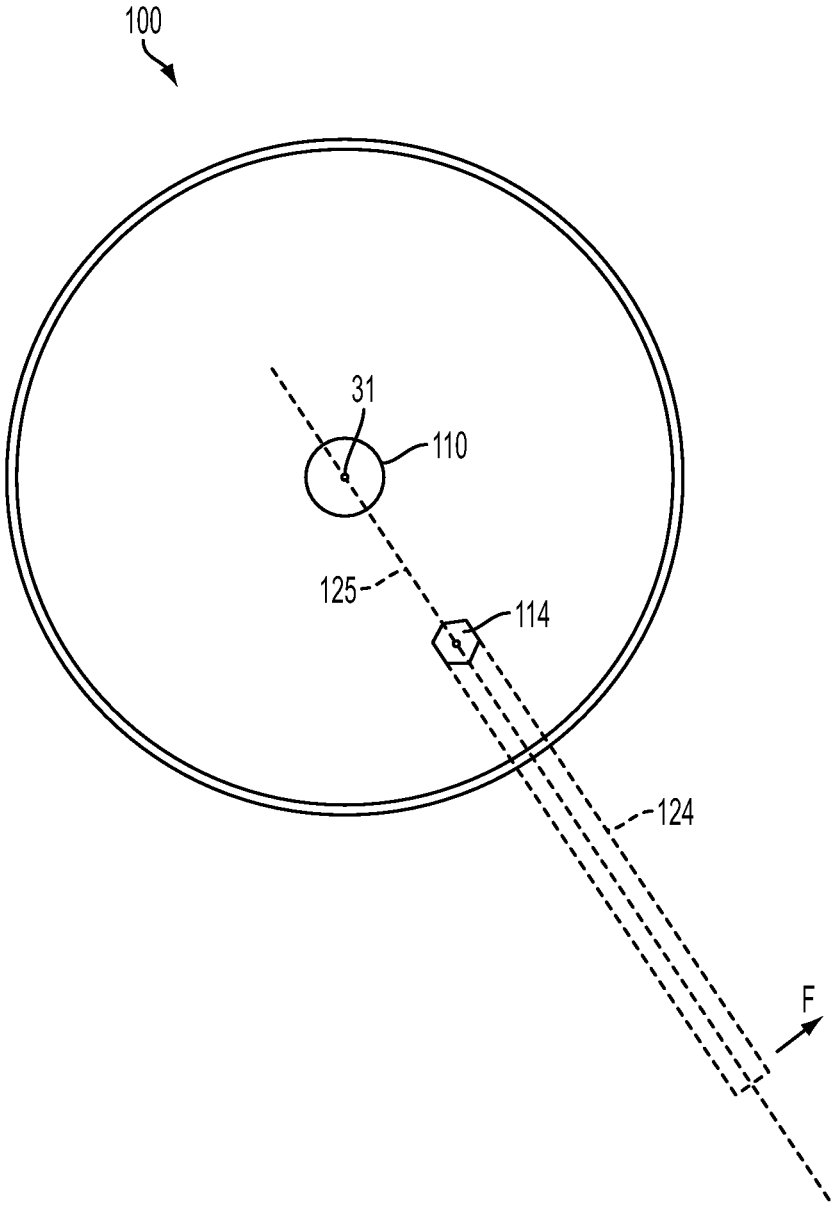
FIG. 5B is a plan view of the flange nut and tool of FIG. 3A.

The flange nut 100 also includes at least one aperture 114 extending from the second surface 106 and at least partially through the body 102 (e.g., completely through the body 102 between the first and second surfaces 104, 106 as shown in FIGS. 4-5) and disposed or located between the annular bore 110 and the outer circumferential surface 108 (e.g., so that the aperture 114 is spaced from the annular bore 110) for receiving a tool that may be used to torque the flange nut 100 in one of first and second opposing directions about the wheel spindle 34 to move the flange nut 100 along the wheel spindle 34. The at least one aperture 114 includes a cross-section (e.g., taken in a direction from the outer circumferential surface 108 towards the annular bore 110) that is other than circular (i.e., the at least one aperture 114 is non-circular) to allow a tool having a non-circular end that is inserted into the aperture 114 and torqued to cause a corresponding torque of the flange nut 100. More specifically, the non-circular cross-section of the aperture 114 serves to eliminate or at least reduce rotational movement of the tool relative to the aperture 114 due to binding between inner walls 116 of the body 102 surrounding the aperture 114 and the shaped end of the tool. As shown in FIG. 5B, when the first portion 120 of the tool 118 is received within aperture 114, the tool is positionable such that an axis 125 of second portion 124 is substantially parallel to a line through a spindle rotation axis 31 and a center of aperture 114. This allows second portion 124 to extend radially relative to spindle rotation axis 31 to provide the greatest possible moment arm about which to apply a force F for tightening or loosening flange nut 100. The orientation of the second portion and the applied force F is shown in FIG. 5B.

In one arrangement, the aperture 114 may have a hexagonal cross-section of any appropriate diameter (e.g., between 5-7 mm, such as at least about 6 mm) that is adapted to receive an end of hex key or Allen wrench 118 also having a hexagonal cross-section. With additional reference now to FIG. 3A, the Allen wrench 118 may include a first portion 120 having an end 122 for insertion into the aperture 114 and a second portion 124 that may be manipulated (e.g., torqued) by a user to induce a corresponding torque of the flange nut 100. As can be appreciated, use of the Allen wrench 118 provides the user with six distinct positions (corresponding to the six sides of the Allen wrench 118) from which the Allen wrench 118 and thus the flange nut 100 can be torqued.

Figure 3B:
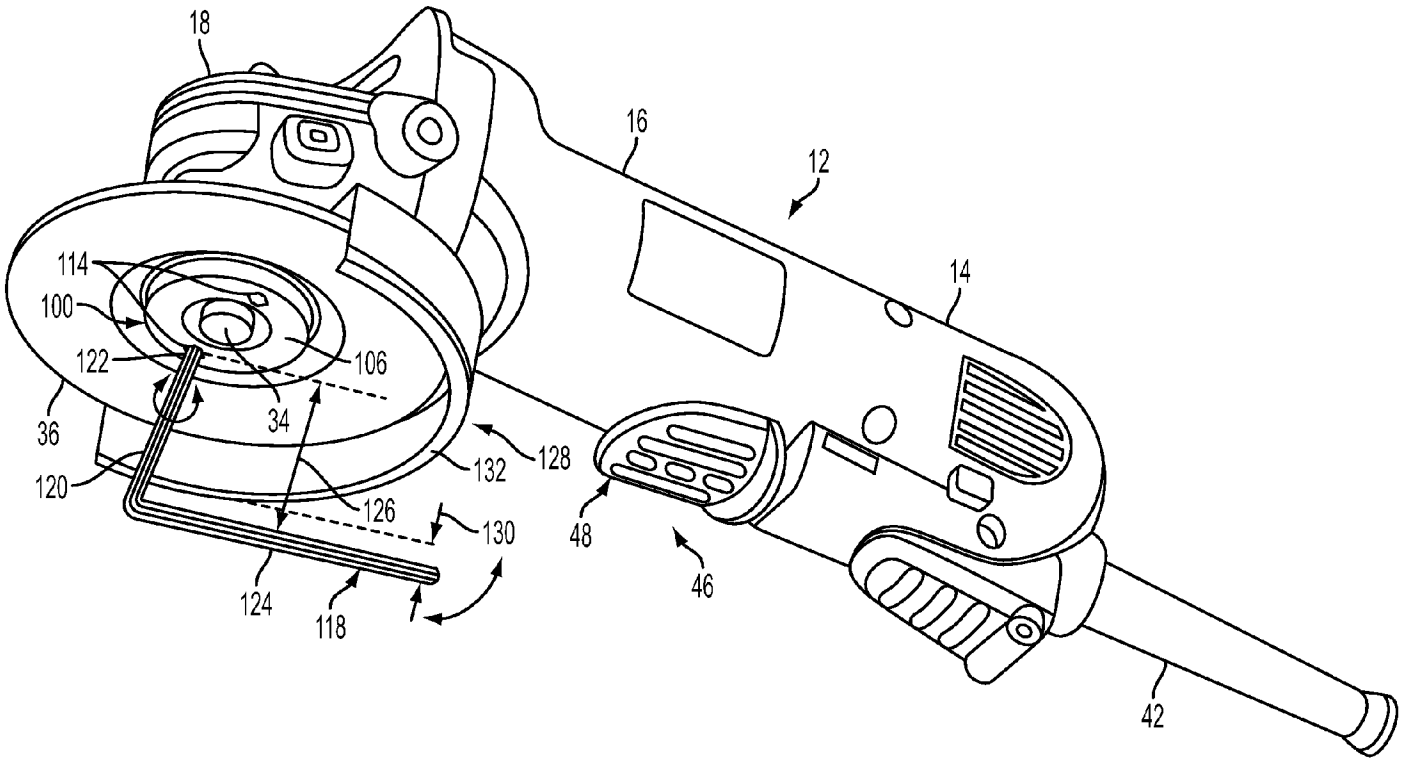
FIG. 3B is a lower perspective view similar to FIG. 3A, but showing the Allen wrench engaged with the flange nut.

Furthermore, and with reference now to FIG. 3B, use of the Allen wrench 118 provides a first offset 126 between the second surface 106 of the flange nut 100 and the second portion 124 of the Allen wrench 118 (e.g., when the end 122 of the Allen wrench 118 is fully inserted into the aperture 114). Also, in the event that the angle grinder 10 includes a guard or shield 128 at least partially surrounding the grinder wheel 36, use of the Allen wrench 118 in the manner described above provides a second offset 130 between an edge 132 of the shield 128 and the second portion 124 of the Allen wrench 118. Advantageously, the first and second offsets 126, 130 provided by use of the Allen wrench 118 reduce the likelihood that a user scrapes or otherwise injures the user's hand (e.g., knuckles) via contact with the flange nut 100, grinder wheel 36, shield 128, and the like (e.g., as compared to using a tool that generally lies parallel to the grinder wheel 36 during operation of such tool to torque the flange nut 100, such as a spanner wrench or the like).

The flange nut 100 may include additional apertures 114. For instance, and with continued reference to FIGS. 3-5, the flange nut 100 may include a second aperture 114 (e.g., having a shape and size the same as that of the previously-discussed first aperture) located between the annular bore 110 and the outer circumferential surface 108 and spaced at least about 180° from the first (previously discussed) aperture 114 about the annular bore 110. Provision of the second aperture 114 advantageously increases the number of positions from which the flange nut 100 can be torqued by the Allen wrench 118 or other tool and provides an additional aperture 114 for use by the Allen wrench 118 in the situation where the first aperture 114 has been stripped. Furthermore, provision of the two apertures 114 may allow for other types of tools to be used such as a spanner wrench having a pin or shaft spacing the same as the distance between the two apertures 114 (e.g., in the event that the Allen wrench 118 was unavailable).

It is also envisioned that the flange nut 100 may include more than two apertures 114 (e.g., 4, 8, etc.) which can be disposed at numerous different orientations about the annular bore 110 relative to each other (e.g., 90°, 45°, etc.). Furthermore, for high torque requirements, (2) two Allen wrenches may be utilized simultaneously in two different apertures to tighten or remove flange nut 100. Additionally, while the present discussion has primarily been in relation to hexagonally-shaped apertures that are sized and shaped to receive Allen wrenches, other shapes and cross-sections of apertures that are sized to receive other types of shaped tools are also envisioned and encompassed within the scope of the present disclosure (e.g., a star-shaped aperture sized to receive a star shaped wrench, a square-shaped aperture sized to receive a ratchet wrench, etc.). In one arrangement, the flange nut 100 may include a first aperture having a first cross-sectional shape (e.g., hexagonal) and a second aperture having a second cross-sectional shape (e.g., star) to allow for the use of two different types of tools for use in adjusting the flange nut 100. In another arrangement, the flange nut 100 may include at least two apertures having the same cross-sectional shape (e.g., hexagonal) but different diameters or sizes to allow for various sized tools to be used with the flange nut (e.g., different sized Allen wrenches).

Figure 6:
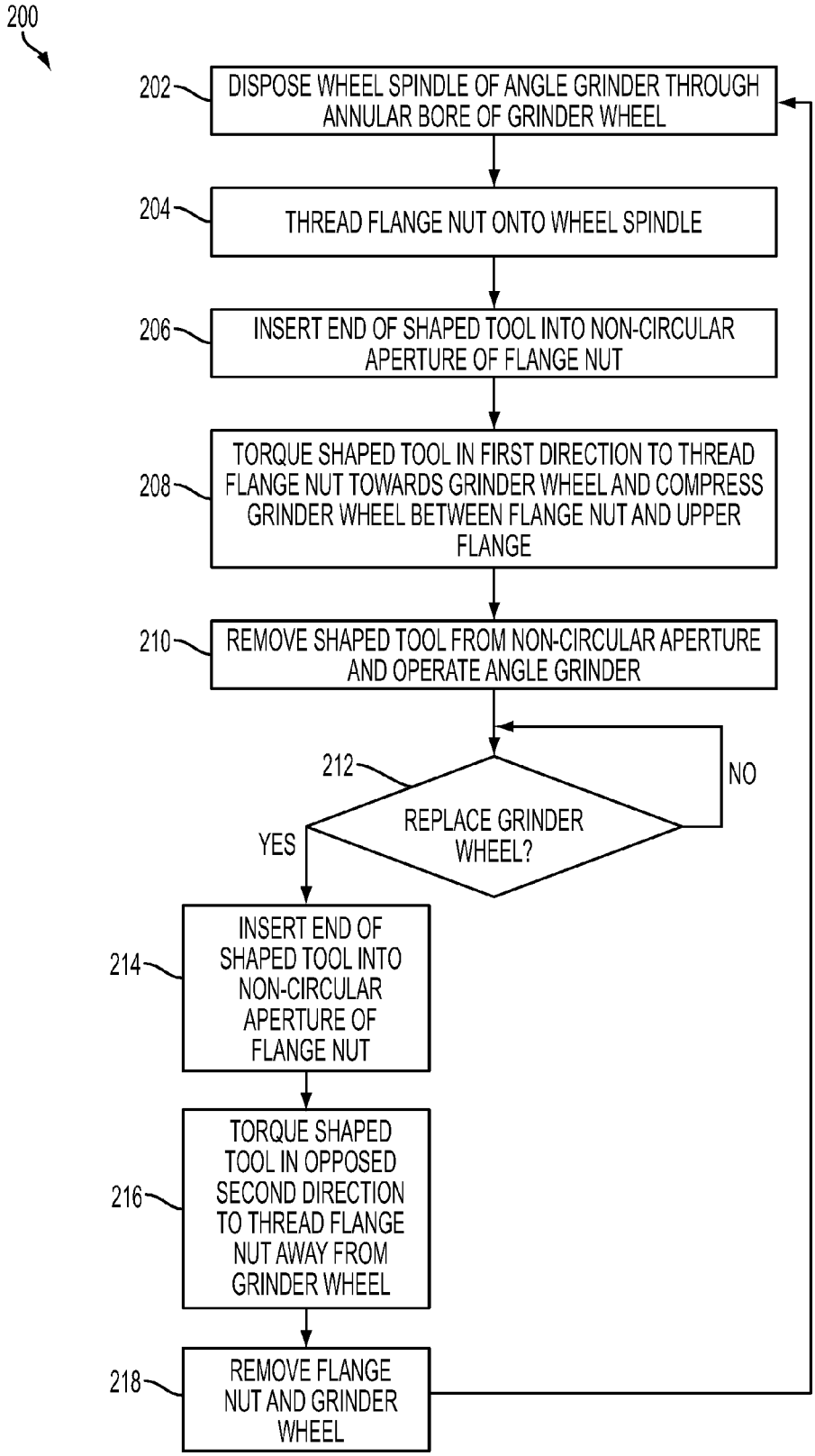
FIG. 6 is a flow diagram illustrating a method of threading the flange nut of FIG. 1 along the spindle.

FIG. 6 illustrates a method 200 of using the flange nut 100 to secure a grinder wheel onto a spindle of an angle grinder, although it is to be understood that numerous other methods are envisioned for use with the flange nut including more, fewer or different steps than those shown in FIG. 6 in addition to other contexts (e.g., with other types of power tools). The method 200 may include disposing 202 the wheel spindle 34 of the angle grinder 10 (or other power tool) through the annular bore 50 of the grinder wheel 36 (or other power tool component) and then threading 204 the flange nut 100 onto the wheel spindle 34. For instance, a user may at least partially hand-thread the flange nut 100 along the wheel spindle towards the grinder wheel 34.

The method 200 may also include inserting 206 the end of a shaped tool (e.g., end 122 of Allen wrench 118) into a non-circular aperture 114 of flange nut 100 (e.g., see FIG. 3B) and torquing 208 or otherwise applying a force to the tool in a first direction (e.g., clockwise) to thread the flange nut 100 about the wheel spindle 34 in the first direction and move the flange nut 100 towards the grinder wheel 36 to compress the grinder wheel 36 between the flange nut 100 and stop 54 (e.g. upper flange). In some arrangements, the method 200 may include disposing the stop 54 over the wheel spindle 34 (e.g., before the grinder wheel 36 and flange nut 100 are so disposed). Furthermore, it is not always necessary that the flange nut 100 and stop 54 are in direct contact with the grinder wheel 36 or other power tool component. In some arrangements, washers or other types of fasteners may be disposed between the flange nut 100 and/or stop 54 and the grinder wheel 36. In any event, the shaped tool may be removed 210 from the non-circular aperture 114 and the power tool may be operated.

The method 200 may also query 212 whether it is desired to replace the grinder wheel 36. In response to a negative answer to the query 212, the method 200 may return to 212 and again query whether replacement of the grinder wheel 36 is desired. It should be appreciated that one or more uses or operations of the angle grinder 10 may ensue before an affirmative answer to the query at 212. In response to an affirmative answer to the query 212, the method 200 may include inserting 214 the end of a shaped tool (e.g., the Allen wrench 118) into the non-circular aperture 114 of the flange nut 100, torquing 216 the tool in an opposed second direction (e.g., counterclockwise) to thread the flange nut 100 about the wheel spindle 34 in the second direction and move the flange nut 100 away from the grinder wheel 36, and removing 218 the flange nut 100 and the grinder wheel 36. The method 200 may then return to 202 to dispose the wheel spindle through the annular bore of another grinder wheel 36 (e.g., of the same or different dimensions and having the same or different surface features).

While this disclosure contains many specifics, these should not be construed as limitations on the scope of the disclosure or of what may be claimed, but rather as descriptions of features specific to particular embodiments of the disclosure. Furthermore, numerous other arrangements are envisioned. For instance, one or more types of kits may be provided such as a flange nut/Allen wrench kit, an angle grinder/flange nut/Allen wrench kit, and the like. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and/or parallel processing may be advantageous. Moreover, the separation of various system components in the embodiments described above should not be understood as requiring such separation in all embodiments, and it should be understood that the described program components and systems can generally be integrated together in a single software and/or hardware product or packaged into multiple software and/or hardware products.

The above described embodiments including the preferred embodiment and the best mode of the invention known to the inventor at the time of filing are given by illustrative examples only.

What is claimed is:

1. An angle grinder, comprising:

a field case having a handle coupled to a first end thereof;

a motor disposed within the field case and having a rotor extending axially therefrom;

a gear case coupled to a second end of the field case opposite the handle and having a wheel spindle extending therefrom, wherein the wheel spindle is operatively coupled to the rotor by at least one gear;

an upper flange disposed about the wheel spindle;

a grinder wheel disposed on the wheel spindle for rotation therewith; and a lower flange disposed about the wheel spindle and opposite the upper flange, wherein the grinder wheel is disposed between the upper and lower flanges, and wherein the lower flange comprises:

a body;

an annular bore extending through the body and that threadingly receives the wheel spindle; and at least one aperture extending at least partially through the body and spaced from the annular bore, wherein the at least one aperture comprises a cross-sectional shape that is other than circular, wherein the at least one aperture is adapted to receive a tool that is sized and shaped to be inserted into the aperture in a substantially non-rotatable manner, and application of rotational force to the tool about the aperture causes the lower flange to rotate about the spindle.

2. The angle grinder of claim 1, wherein the at least one aperture comprises a first aperture, wherein the lower flange further comprises a second aperture extending at least partially through the body and spaced from the annular bore, and wherein the second aperture comprises a cross-sectional shape that is other than circular.

3. The angle grinder of claim 2, wherein the first and second apertures are spaced by about 180° about the annular bore.

4. The angle grinder of claim 1, wherein the cross-sectional shape is polygonal.

5. The angle grinder of claim 1, wherein the upper and lower flanges are in contact with the grinder wheel.

6. A kit, comprising:

the angle grinder of claim 1; and the tool that is sized and shaped to be inserted into the aperture in a substantially non-rotatable manner.

7. The kit of claim 6, wherein the tool is L-shaped and has a polygonal cross section.

8. A flange nut that is adapted to be threaded along a rotatable spindle of a power tool, the flange nut comprising:

a nut body including a first surface that is adapted to face a power tool component, a second surface that is generally opposed to the first surface, and an outer circumferential surface between the first and second surfaces;

an annular bore extending through the nut body between the first and second surfaces for receiving the rotatable spindle; and at least one aperture extending at least partially through the nut body and located between the annular bore and the outer circumferential surface, wherein the at least one aperture comprises a cross-sectional shape that is other than circular, and wherein the at least one aperture is adapted to receive a tool such that subsequent movement of the tool in a first rotational direction causes the flange nut to rotate in a first direction about the spindle and move towards the power tool component, and whereby movement of the tool in a second rotational direction causes the flange nut to rotate in a second direction about the spindle and move away from the power tool component.

9. The flange nut of claim 8, wherein the at least one aperture comprises a first aperture, wherein the flange nut further comprises a second aperture extending at least partially through the nut body and located between the annular bore and the outer circumferential surface, and wherein the second aperture comprises a cross-sectional shape that is other than circular.

10. The flange nut of claim 9, wherein the cross-sectional shapes of the first and second apertures are identical.

11. The flange nut of claim 9, wherein the cross-sectional sizes of the first and second apertures are identical.

12. The flange nut of claim 11, wherein the cross-sectional sizes of the first and second apertures are different.

13. The flange nut of claim 9, wherein the cross-sectional shapes of the first and second apertures are different.

14. The flange nut of claim 8, wherein the nut body comprises an inner circumferential surface that surrounds the annular bore, and wherein at least a portion of the inner circumferential surface comprises a threaded surface that is adapted to threadingly mate with a corresponding threaded surface on the spindle.

15. The flange nut of claim 8, wherein the cross-sectional shape of the at least one aperture is polygonal.

16. The flange nut of claim 8, wherein the at least one aperture adapted to receive a tool actually receives a tool, and wherein the tool is L-shaped, the tool has a first portion and a second portion, and wherein an axis of the second portion is substantially positionable parallel to a line through a spindle rotation axis and a center of the tool opening when the tool is operating in the aperture.

17. A power tool, comprising:

a rotatable spindle;

a first flange having a central bore that receives the spindle;

a power tool component having a bore that receives the spindle, wherein the power tool component is disposable against the first flange; and a second flange having a first surface, an opposed second surface, a central bore that receives the spindle, and an aperture that extends partially through a body of the second flange, is spaced from the central bore and that includes a cross-sectional shape that is other than circular, wherein the aperture is adapted to receive a tool such that subsequent movement of the tool in a first direction causes the second flange to rotate in a first direction about the spindle and compress the power tool component between the first and second flanges, and whereby movement of the tool in a second direction causes the second flange to rotate in a second direction about the spindle and move away from the power tool component.

18. The power tool of claim 17, wherein the second flange comprises an inner threaded surface surrounding the central bore that is adapted to threadingly mate with a corresponding threaded surface on the spindle.

19. The power tool of claim 17, wherein the power tool component comprises a grinder wheel.

20. A kit, comprising:

a flange adjusting tool; and the power tool of claim 17.

21. The kit of claim 20, wherein the tool comprises an L-shape.

22. A method, comprising:

inserting a correspondingly shaped end of a tool into a non-circular aperture of a nut that extends at least partially through a body of the nut and is threadably disposed over a spindle, wherein the spindle and nut form part of a power tool, and wherein the power tool further comprises a power tool component disposed on the spindle between the nut and a flange; and applying a force to the tool about the aperture to thread the nut along the spindle.

23. The method of claim 22, wherein the tool comprises an L-shape, and wherein the applying step comprises:

urging a portion of the tool to thread the nut along the spindle.

24. The method of claim 22, wherein the end of the tool is non-rotatable relative to the non-circular aperture during the applying step.

25. The method of claim 22, wherein the aperture is offset from an axis of rotation of the spindle.

26. The method of claim 25, wherein the applying step compresses the power tool component between the nut and the flange, and wherein the tool only engages one aperture and a force is applied to only one aperture.

27. The method of claim 22, wherein the applying step threads the nut along the spindle away from the flange.

28. The method of claim 27, further comprising after the applying step:

removing the nut from the spindle.

29. The method of claim 22, wherein the power tool component comprises a grinder wheel.

30. The method of claim 22, further comprising after the applying step:

removing the tool from the non-circular aperture.

* * * * *